United States Patent [19]

Matsubara et al.

[11] Patent Number: 5,074,232

[45] Date of Patent: Dec. 24, 1991

[54] PATTERN SEWING MACHINE

[75] Inventors: Kenji Matsubara, Aichi; Fujio Horie, Nagoya, both of Japan

[73] Assignee: Brother Kogyo Kabushiki Kaisha, Nagoya, Japan

[21] Appl. No.: 557,110

[22] Filed: Jul. 25, 1990

[30] Foreign Application Priority Data

Jul. 27, 1989 [JP] Japan ..... 1-195301
Jul. 31, 1989 [JP] Japan ..... 1-200051

[51] Int. Cl.[5] ..... D05B 3/02

[52] U.S. Cl. ..... 112/445; 112/454; 112/456

[58] Field of Search ..... 112/454, 453, 456, 457, 112/458, 445, 103, 121.12, 306, 308, 303

[56] References Cited

U.S. PATENT DOCUMENTS 4,226,199 10/1980 Adams ..... 112/308
4,413,574 11/1983 Hirota et al. ..... 112/121.12
4,622,907 11/1986 Kimura ..... 112/454 X
4,633,796 1/1987 Hoffman-Glewe et al. ..... 112/314
4,688,503 8/1987 Kato ..... 112/445
4,691,654 9/1987 Meier ..... 112/303
4,967,674 11/1990 Rohr et al. ..... 112/306 X

*Primary Examiner*—Peter Nerbun
*Attorney, Agent, or Firm*—Oliff & Berridge

[57] ABSTRACT

In the pattern sewing machine comprising a pattern selector for selecting and combining pattern units such as characters and symbols and a controller for driving a sewing mechanism and a feeding mechanism to form the combination of pattern units selected by the pattern selector, the controller is provided with a diagonal placing unit for placing one pattern unit in a diagonal direction relative to another pattern unit adjacent thereto when the two adjacent pattern units are sewn in series.

20 Claims, 16 Drawing Sheets

FIG. 4A

| COMBINATION POINTER | PATTERN |
|---|---|
| 0 | A |
| 1 | ↗ |
| 2 | B |
| 3 | ↘ |
| 4 | C |
| 5 | |
| ⋮ | ⋮ |
| 28 | |
| 29 | |

FIG. 4B

| DATA POINTER | STEP PATTERN DATA |
|---|---|
| 0 | PRIMARY FEED AMOUNT: 0mm<br>NEEDLE ROCK LOCATION: UNCHANGED<br>LATERAL FEED AMOUNT: 0.7mm<br>NEEDLE BAR RELEASE |
| 1 | PRIMARY FEED AMOUNT: 0mm<br>NEEDLE ROCK LOCATION: UNCHANGED<br>LATERAL FEED AMOUNT: 0.7mm<br>NEEDLE BAR RELEASE |
| ⋮ | ⋮ |
| 19 | PRIMARY FEED AMOUNT: 0mm<br>NEEDLE ROCK LOCATION: UNCHANGED<br>LATERAL FEED AMOUNT: 0.7mm<br>NEEDLE BAR RELEASE |

FIG. 5

| TYPE OF PATTERN | | WIDTH OF PATTERN (mm) | TOTAL DATA NUMBER |
|---|---|---|---|
| SATIN PATTERN | | 7.0 | 6 |
| | | 6.5 | 6 |
| | | 6.0 | 6 |
| | | 5.5 | 5 |
| | | ⋮ | ⋮ |
| | | 2.0 | 2 |
| | | 1.5 | 1 |
| | | 1.0 | 1 |
| | | 0.5 | 1 |
| | | 0 | 1 |
| CHARACTER PATTERN | NORMAL SIZE | LARGE | 6 |
| | | MEDIUM | 5 |
| | | SMALL | 4 |
| | | LARGE | 20 |
| | | SMALL | 12 |

FIG. 11B

| DATA POINTER | RIGHT FEED DATA |
|---|---|
| 0 | PRIMARY FEED AMOUNT: 0mm<br>NEEDLE ROCK LOCATION: UNCHANGED<br>LATERAL FEED AMOUNT: 0.7mm<br>NEEDLE BAR RELEASE |
| 1 | PRIMARY FEED AMOUNT: 0mm<br>NEEDLE ROCK LOCATION: UNCHANGED<br>LATERAL FEED AMOUNT: 0.7mm<br>NEEDLE BAR RELEASE |
| . | |
| DATA POINTER | STEP PATTERN DATA |
| 4 | PRIMARY FEED AMOUNT: 0mm<br>NEEDLE ROCK LOCATION: UNCHANGED<br>LATERAL FEED AMOUNT: 0.7mm<br>NEEDLE BAR RELEASE |

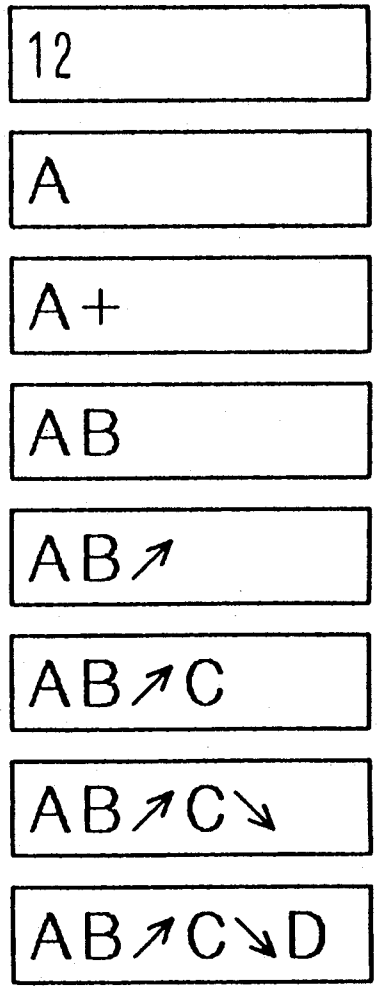
FIG. 14A
FIG. 14B
FIG. 14C
FIG. 14D
FIG. 14E
FIG. 14F
FIG. 14G
FIG. 14H
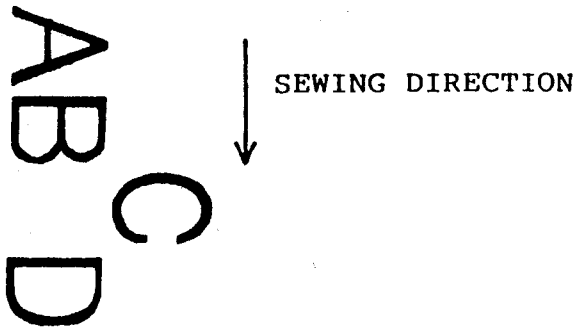
FIG. 13

PATTERN SEWING MACHINE

BACKGROUND OF THE INVENTION

1. Field of the Invention

The present invention relates to a pattern sewing machine and more particularly to a pattern sewing machine which is provided with a fabric transfer means for transferring fabric in a lateral direction.

The present invention relates to a pattern sewing machine, and more particularly to a sewing machine which selects a combination of pattern units such as characters and signs and forms the combination of pattern units in a line on a fabric by driving a sewing mechanism and a fabric feed mechanism.

2. Related art

A conventional pattern sewing machine can sew a plurality of two-dimensional patterns such as characters and signs on a fabric. It has been proposed to provide this type of pattern sewing machine with a function to rock the sewing needle in a lateral feed direction which is parallel to the axis of the arm of the sewing machine. Another proposed function is to transfer the fabric in the lateral feed directions as well as back and forth in a primary feed direction which is at a right angle to the lateral feed direction. With these functions a pattern sewing machine can sew selected patterns in different sizes.

Such a sewing machine has a memory of a set of needle location data for sewing each pattern and sews selected patterns in a sewing order based on the needle location data. To change the size of a pattern, the distances among the needle locations are either widened or shortened. The change of the distances is achieved by changing the rocking amount of the sewing needle or the feed of the fabric.

In the conventional pattern sewing machine, characters, signs, or other patterns (referred to as pattern units hereinafter) are usually sewn in a straight line. Furthermore, if some pattern units such as letters, which have a direction, can be rotated by 90° when they are sewn, such unit patterns can be sewn in two different arrangements. The space between pattern units can be altered in the primary feed direction by changing the feed amount per feeding operation, the maximum feed amount being several millimeters per feeding operation. However, pattern units cannot be sewn out of the straight line; that is to say, the line of the pattern units cannot change its course in the lateral feed direction. For instance, the pattern unit B of the combination of the pattern units A, B, and C cannot be moved in the lateral feed directions shown in FIG. 7 because the lateral feed amount can not be accurately controlled. The maximum lateral feed amount per operation is as small as approximately 0.7 mm; so if the lateral feed amount is adjusted, for example, to 0.2 mm, the actual feed amount no longer corresponds to the feed amount supposedly obtained by the feed dog due to friction or stretch of the fabric, thus controlling the lateral feed amount is difficult.

Therefore, the conventional pattern sewing machine, even though it can automatically sew complicated pattern units, must have an operator adjust the position of the fabric in order to sew a pattern unit out of a straight line in the lateral feed direction. However, the manual change of the fabric position may not produce a neat and well-balanced arrangement of pattern units on the fabric.

Furthermore, in the conventional pattern sewing machine, the direction in which the combined pattern units area sewn is limited. Therefore, it has not been possible to sew pattern units in a variety of sewing directions other than in the straight line in the primary feed direction. A sewing machine which can sew a previously unattainable formation of combined pattern units will greatly enhance the aesthetic value of patterns.

SUMMARY OF THE INVENTION

An object of the present invention is to solve the above-identified problem and to provide a pattern sewing machine that can laterally change the course of a line of pattern units and maintain a well-balanced and neat arrangement of the pattern units sewn on the fabric.

Another object of the present invention is to provide a pattern sewing machine that can sew pattern units in a variety of directions.

A pattern sewing machine of the present invention shown in FIG. 1 comprises: a transfer means Ml for transferring a fabric back and forth in the primary feed direction in synchronization with a vertically reciprocating motion of the sewing needle and in the lateral feed direction by a predetermined distance per feeding operation; a needle drive means M2 for driving the needle in a vertically reciprocating motion and rocking the needle in the lateral feed direction; a pattern selection means M3 for selecting pattern units such as characters and signs to be sewn on the fabric; a size determination means M4 for determining the size of the selected pattern unit sewn on the fabric; a sewing control means M5 for driving the transfer means M1 and the needle drive means M2 in order to sew the selected pattern units successively in predetermined sizes; and a lateral feed instruction means M6 for giving instructions so that the selected pattern units are sewn in the lateral feed direction. The sewing controlling means M5 further comprises a calculation means M7, for calculating a required number of lateral feed operations based on the size of the selected pattern units upon receiving instructions from the lateral feed instruction means M6; and a lateral feed control means M8 for transferring the fabric in the lateral feed direction by driving the transfer means Ml to perform the required number of lateral feed operations based on the result obtained by the calculation means M7.

In operation, the sewing control means M5 of the first-embodiment pattern sewing machine of the present invention drives the transfer means Ml and the needle drive means M2 to sew pattern units selected by the pattern selection means M3 in the size determined by the size determination means M4 in order. Upon receiving instructions from the lateral feed instruction means M6 to sew the selected pattern units out of a straight line in the lateral feed direction, the calculation means M7 of the sewing control means M5 calculates the number of lateral feed operations for transferring a fabric W by a required distance based on the size of the selected pattern units. The lateral feed control means M8 transfers the fabric W in a lateral direction by driving the transfer means Ml to perform the required number of lateral feed operations control.

As shown in FIG. 8, a second embodiment of the present invention comprises a pattern selection means M9 for selecting and combining pattern units such as characters and symbols and a control means M12 for driving a sewing mechanism M10 and a feeding mechanism M11 to form the combination of pattern units selected by the pattern selection means M9, where the control means M12 is provided with a diagonal placement means M13 for placing one pattern unit in a diagonal direction to another pattern unit adjacent thereto when the two adjacent pattern units are sewn in series.

In operation, the second-embodiment pattern sewing machine of the present invention sews patterns after the pattern selection means M9 selects and combines pattern units such as letters and symbols. When the control means M12 drives the sewing mechanism M10 and the feeding mechanism M11 to form the combination of pattern units selected by the pattern selection means M9, the diagonal placement means M13 provided in the control means M4 places one pattern unit in a diagonal position to another pattern unit adjacent thereto.

BRIEF DESCRIPTION OF THE ATTACHED DRAWINGS

FIG. 4A illustrates a combination pointer and designated patterns of the first embodiment.

FIG. 4B illustrates a data pointer and stored step data of the first embodiment.

FIG. 5 illustrates types of patterns, their widths, and total data numbers of corresponding step patterns.

FIGS. 11A-D show the data structures of various data located in predetermined areas of a RAM and a ROM in a computer of the second embodiment of the present invention.

Figure 12A:
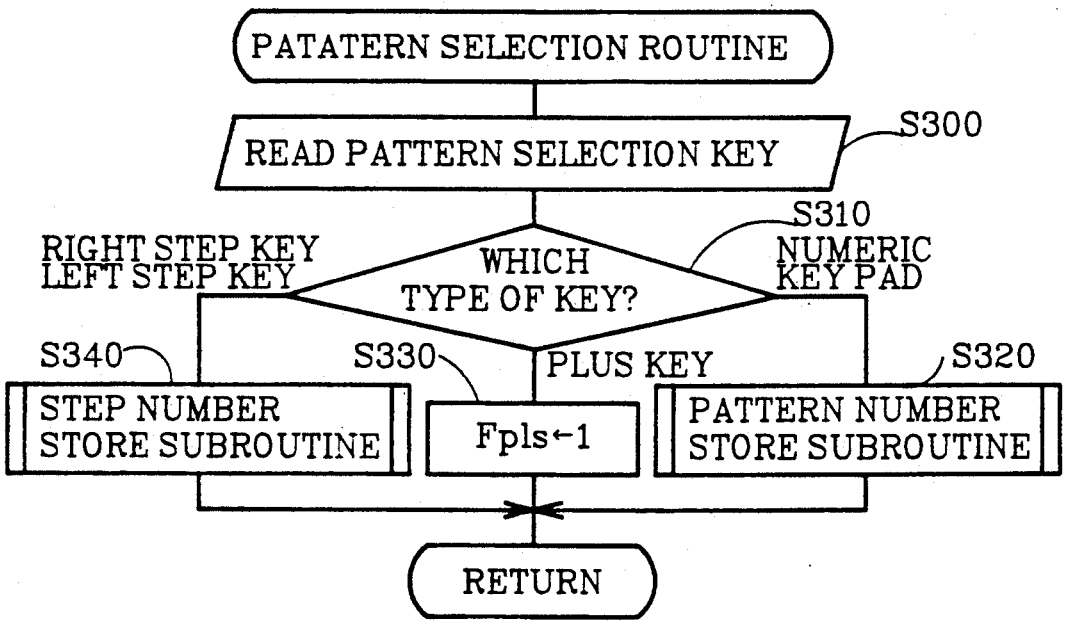
Figure 12B:
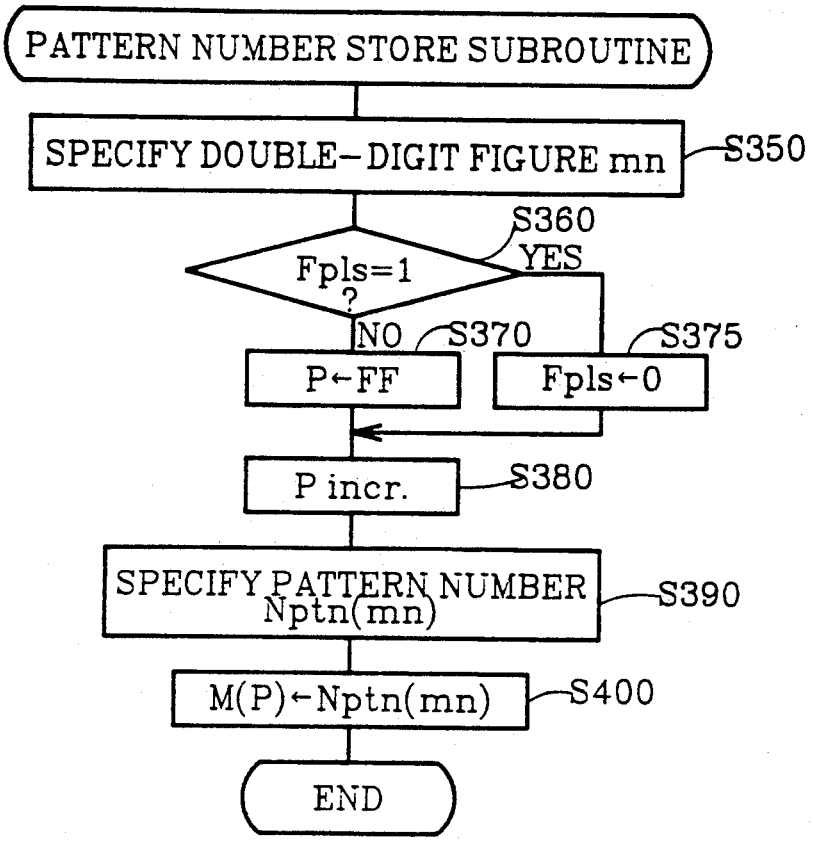
Figure 12C:
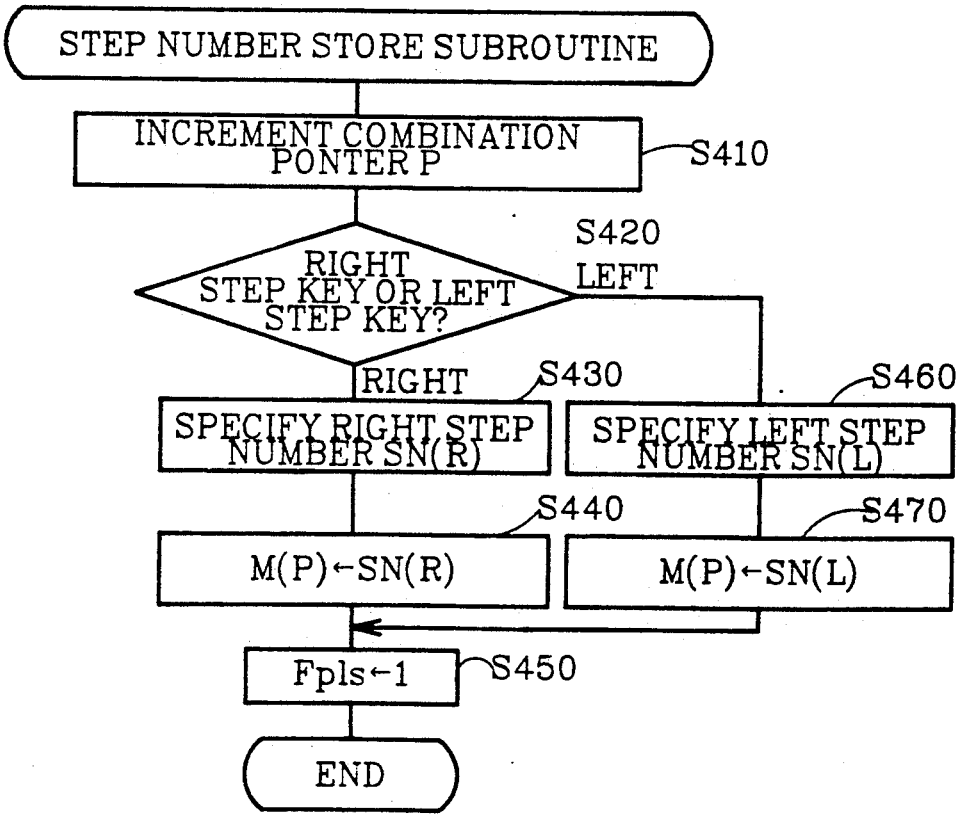

FIG. 12A-C are flowcharts showing the process of the second embodiment of the present invention.

FIG. 13 shows an example of patterns sewn on a fabric in accordance with the second embodiment of the present invention.

FIGS. 14A-H are displays shown on a LCD in various steps of processing in the second embodiment of the present invention.

DETAILED DESCRIPTION OF THE PREFERRED EMBODIMENTS

First Embodiment

Figure 3:
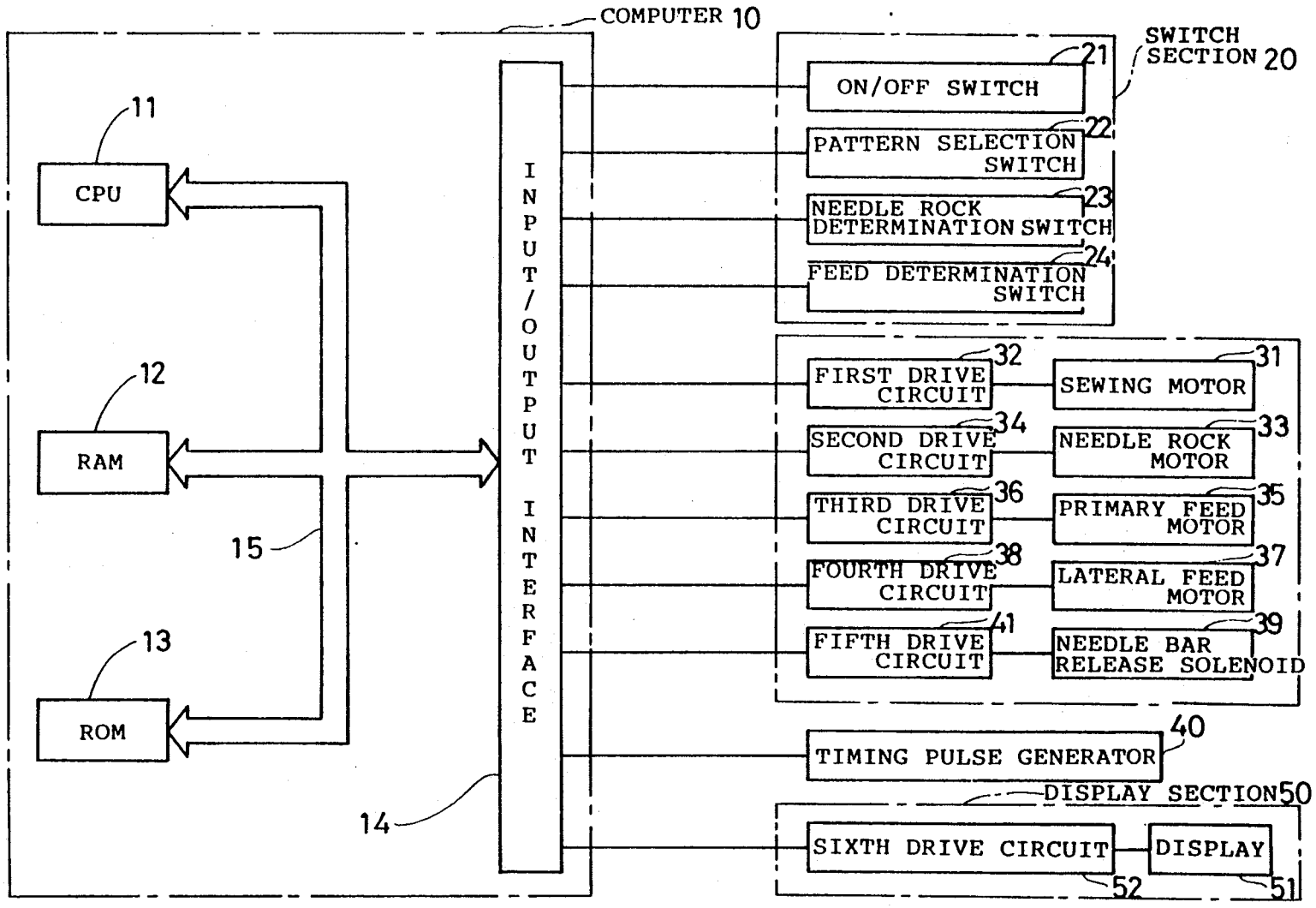
FIG. 3 is a block diagram showing the electrical composition of the sewing machine of the first embodiment of the present invention.

Referring first to FIG. 3, there is shown a systematic illustration of a pattern sewing machine of the present invention which includes a computer 10 for exercising overall control of the pattern sewing machine, a switch section 20 for determining various conditions of sewing, a drive section 30 for driving a sewing mechanism to sew on a fabric W, a timing pulse generator 40 for generating timing pulses to control the operation of the sewing mechanism, and a display section 50 for displaying the patterns selected and their sizes as determined by the switch section 20.

The computer comprises a CPU 11, a RAM 12, a ROM 13, an input/output interface 14 for converting external input/output signals into the signals which the CPU 11 can process, and a bus 15 for connection thereof.

The RAM 12 is provided with various pointers explained below, including a combination pointer and a data pointer, flags, counters, and a memory that temporarily retains results processed by the CPU 11.

The ROM 13 stores pattern data which determines the needle locations (a set of points where the needle penetrates the fabric W) for a plurality of characters, signs or other patterns, a control program which controls the drive section 30 in accordance with the sewing conditions determined by the switch section 20, and another control program for controlling pattern data set routine, which is explained below.

The switch section 20, which sends signals to the input/output interface 14 of the computer 10, comprises an on/off switch 21 for switching on and off the pattern sewing machine, pattern selection switches 22 for selecting desired patterns by entering double-digit figures corresponding to the desired patterns using a numeric key pad 22*a*, needle rock determination switches 23 for determining the lateral width of a pattern by controlling the rocking amount of a needle bar 61 in the axial direction of an arm 62 (indicated by an arrow X and referred to as the lateral feed direction hereinafter), feed determination switches 24 for determining the width of a pattern in the primary feed direction at a right angle to the feed direction by adjusting the lateral feed amount of a feed dog 63 for feeding the fabric W. The primary feed direction is indicated by an arrow Y.

Figure 1:
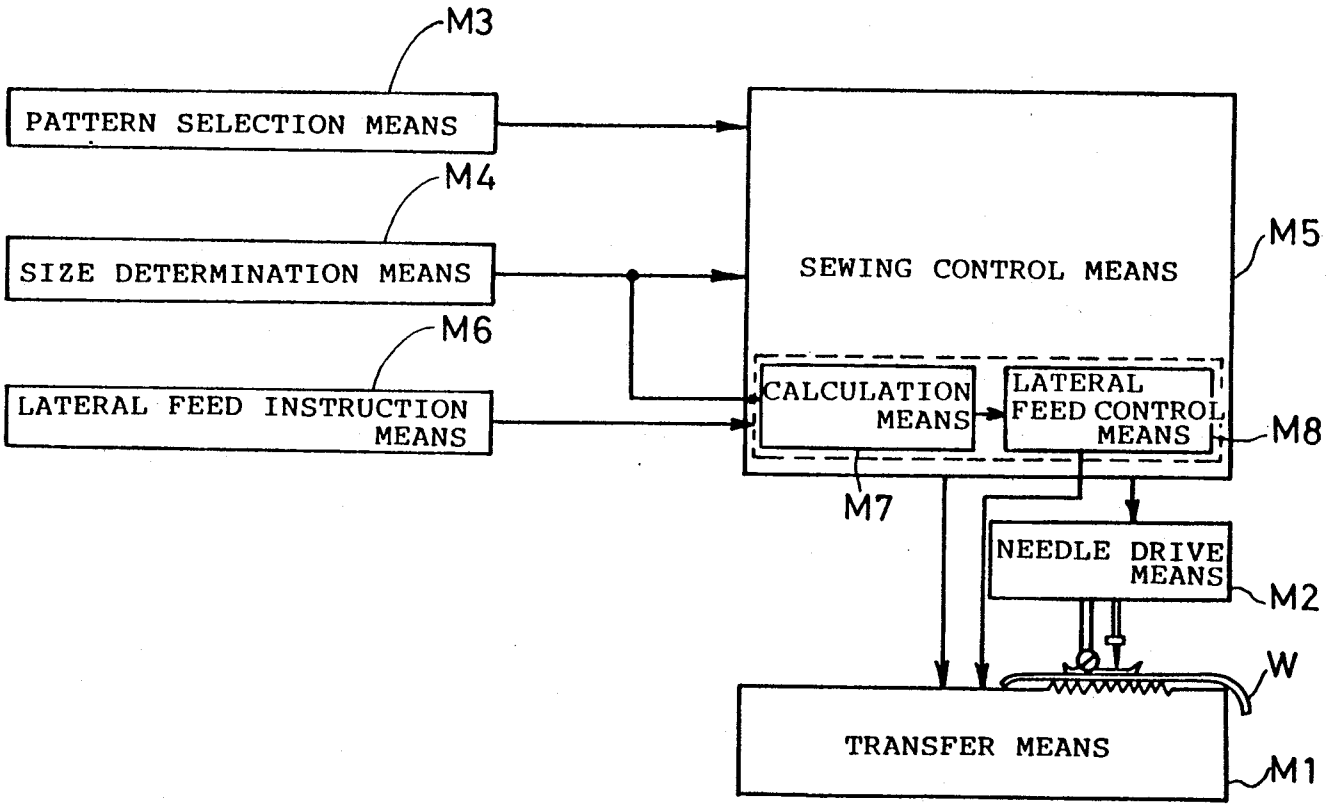
FIG. 1 is a block diagram showing the composition of a first embodiment of the present invention.
Figure 2:
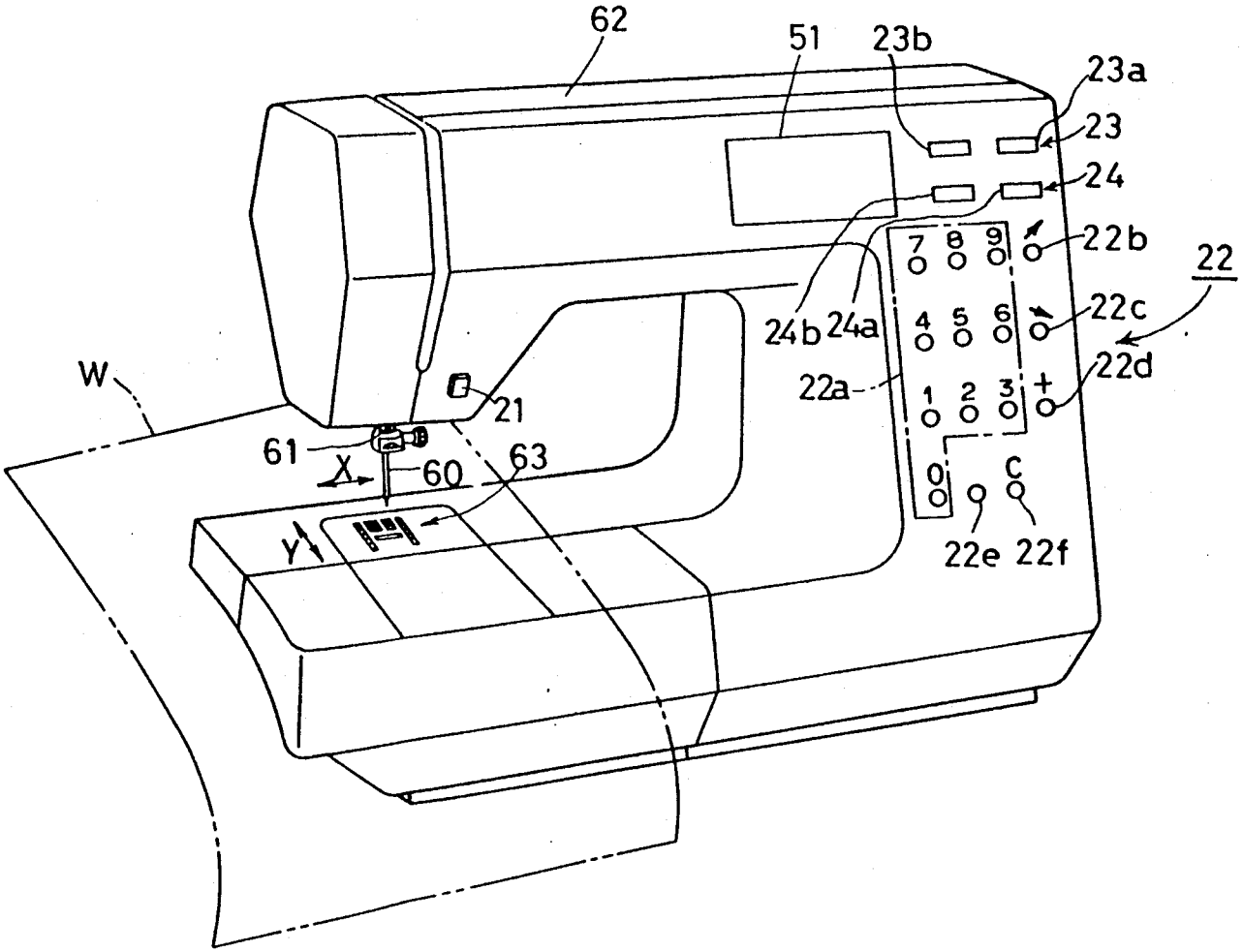
FIG. 2 is a perspective view of a pattern sewing machine of the first embodiment of the present invention.

As illustrated in FIG. 2, the pattern selection switches 22 comprise the numeric pad 22*a* for entering double digit pattern selection figures, a right step key 22*b* for diagonally placing patterns to the right, a left step key 22*c* for diagonally placing patterns to the left, a pattern combination key 22*d* for combining a plurality of patterns, a repeat key 22*e* for repeatedly sewing a combination of patterns, and a clear key 22*f*.

The needle rock determination switches 23 comprise a first enlargement key 23*a* for enlarging the width of a pattern in the lateral feed direction and a first reduction key 23*b* for reducing the width of a pattern in the lateral feed direction.

Likewise, the feed determination switches 24 comprise a second enlargement key 24*a* for enlarging the width of a pattern in the primary feed direction, and a second reduction key 24*b* for reducing the width of a pattern in the primary feed direction.

The size of a selected pattern is determined by operation of the above switches 23 and 24. Each push of the above switches 23*a*, 23*b*, 24*a*, or 24*b* changes the degree of enlargement or reduction of a satin pattern by one size away from the preset standard size. The number of switch depressions, therefore, determines the size of a satin pattern. To determine the size of a character or sign pattern, either the needle rock determination switches 23 or the feed determination switches 24 are used. There are three different sizes to choose from for each character or sign pattern.

The drive section 30 comprises a sewing motor 31 for rotating a sewing shaft (not shown) such that the needle bar 61 provided with a needle 60 is vertically driven while vertically driving the dog feed 63 to feed the fabric W, a first drive circuit 32 for driving the sewing motor 31, a needle rock motor 33 for rocking the needle bar 61 in the lateral feed direction, a second drive circuit 34 for driving the needle rock motor 33, a primary feed motor 35 for feeding the fabric W in the primary feed direction, a third drive circuit 36 for driving the primary feed motor 35, a lateral feed motor 37 for feeding the fabric W in the lateral feed direction, a fourth drive circuit 38 for driving the lateral feed motor 37, a needle bar release solenoid 39, and a fifth drive circuit 41 for driving the needle bar solenoid 39. These drive circuits 32, 34, 36, 38, and 41 are connected to the input-/output interface 14 of the computer 10 and drive the motors 31, 33, 35, and 37 and the needle bar release solenoid 39 in accordance with control signals transmitted from the computer 10.

U.S. Pat. Application No. 07/525,839 now U.S. Pat. No. 5,000,105 generally describes the drive section 30 and the method in which a pattern is sewn on the fabric W by the drive section 30.

The timing pulse generator 40 comprises a disc fixed on the sewing shaft and a photo-interrupter, and the generation of timing pulse signals occurs in predetermined intervals in synchronization with the rotation of the sewing shaft. The generated timing pulses are transmitted to the computer 10. The needle rock motor 33, the primary feed motor 35, and the lateral feed motor 37 are controlled by the second, third, and fourth drive circuits 34, 36, and 38, respectively, based on the transmitted timing pulse signals.

The display section 50 comprises a display 51 for displaying selected patterns, their sizes, and so forth by means of a liquid crystal dot matrix display 51 and a sixth drive circuit 52 for driving the display 51.

Turning now to FIG. 4, a combination pointer and a data pointer provided in the RAM 12 are explained hereinafter. The combination pointer specifies the sewing order of the combination of patterns determined by the pattern selection switches 22.

The data pointer chooses one set of needle location data for each pattern from a plurality of sets of needle location data provided as pattern data. When a combination of selected patterns is determined, the combination pointer specifies the areas numbered from No. 0 to 29 where pattern code numbers corresponding to the selected patterns are successively stored. (In other words, the pattern number of a third pattern, for example, is stored in the area No. 3) A pattern number is a programed number used to specify the corresponding pattern, not the double-digit pattern selection number entered by the operator. In FIG. 4A, characters and step symbols, instead of pattern code numbers, are shown for convenience. In this case a character A, a right step symbol, a character B, a left step symbol, and a character C successively selected by the pattern selection switches 22 are stored in the areas No. 0–4. More specifically, characters A, B, and C are selected by the numeric key pad 22*a* while the right and left step symbols are selected by the right and left step keys 22*b* and 22*c*.

Pattern data corresponding to the pattern code numbers are stored in a table (not shown) of the ROM 13. Pattern data for a pattern is composed of data for feed amount in the primary feed direction (referred to as primary feed amount hereinafter), needle rock amount, feed amount in the lateral feed direction (referred to as lateral feed amount hereinafter), and either needle bar engagement or needle bar release for each of the needle locations necessary to sew the pattern. In needle bar engagement, the needle bar 61 is driven vertically by the rotation of the sewing shaft. On the other hand, in needle bar release, the needle bar 61 is allowed to remain at the highest point of stroke by a clutch mechanism (not shown). The number of data corresponding to the number of needle locations for sewing a pattern is referred to as a total data number hereinafter.

The right step arrow and the left step arrow shown in FIG. 4A diagonally place the patterns selected immediately thereafter to the right and left, respectively. Even though no actual patterns are sewn on the fabric W based on the right step or the left arrows, corresponding pattern data is stored in the ROM 13. The data pointer specifies the needle locations of the two arrows during sewing. The right and left step arrows are referred to as step patterns and their pattern data are referred to as step pattern data hereinafter.

As FIG. 4B shows, the step pattern data indicated by the data pointer No. 0 to 19 carries the identical data. The step data comprises: the primary feed amount, which is 0 mm; the needle rock amount, which is unchanged from the previous amount; the lateral feed amount, which is 0.7 mm; and release of the needle. Therefore, when read by the data pointer, the step pattern data instructs the feed dog 63 to feed the fabric W in the lateral feed direction by 0.7 mm. When a step pattern is executed, the needle rock location remains unchanged from that of the immediately previous pattern data.

The total data number of step pattern data required to sew a given pattern is, unlike that of ordinary pattern data, between 1 and 20 depending on the type and size of the selected patterns. The type and size of a pattern is selected by the needle rock determination switches 23 and the feed determination switches 24, respectively.

FIG. 5 shows the total data numbers of step patterns corresponding to various types of patterns except for satin patterns. In case of satin patterns, the total data numbers of corresponding step patterns are between 1 and 6 depending on the lateral width of a satin pattern in the lateral feed direction, the width being determined by the needle rock amount switches 23.

In case of normal-sized character patterns, including letters and symbols, which are further divided into three sub-sizes: large; middle; and small, the total data numbers of corresponding step patterns are 6, 5, and 4, respectively.

In case of enlarged characters, including; letters and symbols, which are further divided into two sub-sizes, large and small, and the total data numbers of corresponding step patterns are 20 and 12, respectively.

Figure 6:
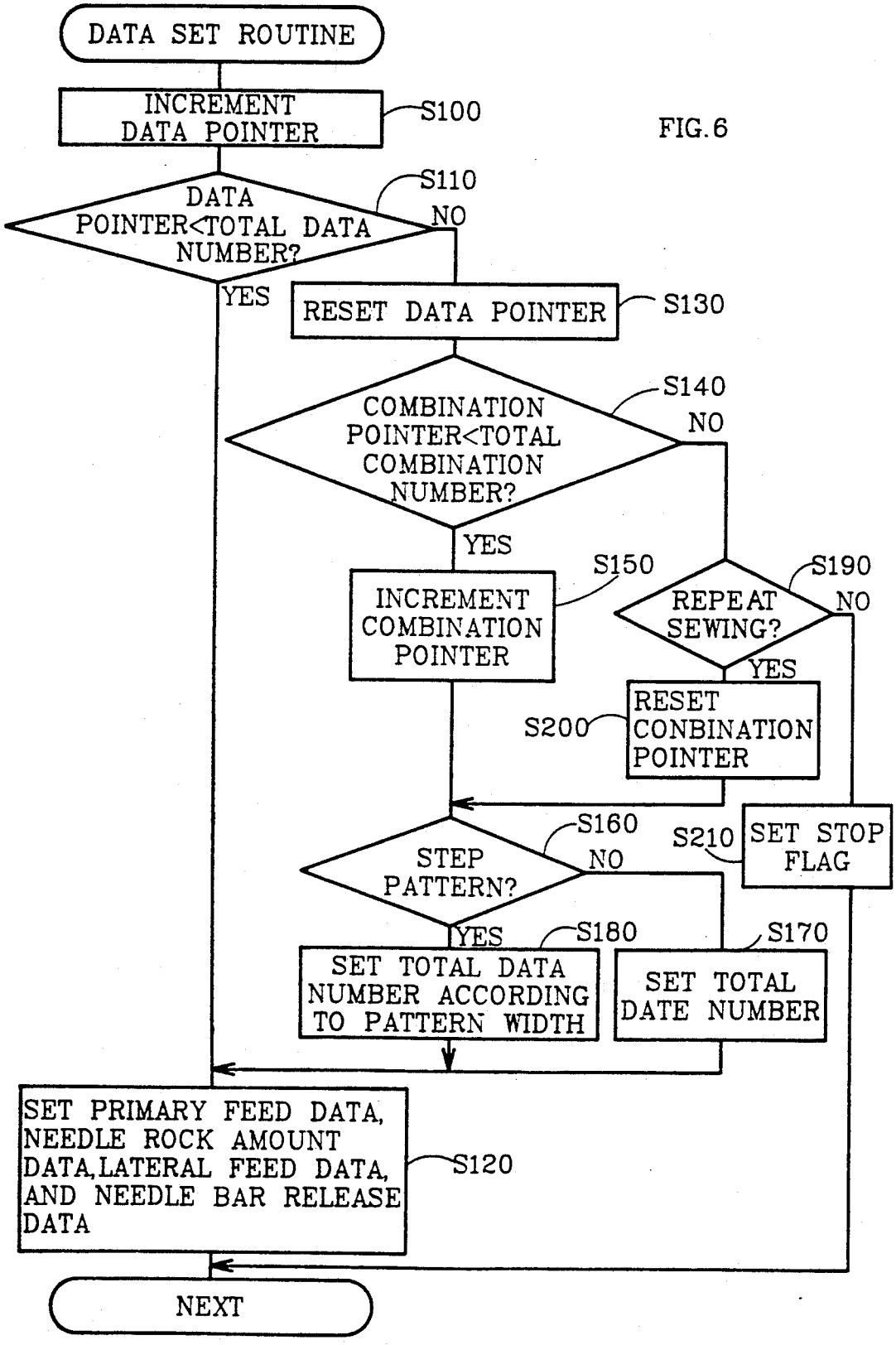
FIG. 6 is a flowchart of a pattern set routine of the first embodiment.

Referring now to a flowchart of FIG. 6, a data set routine carried out by the computer 10 is explained hereinafter. The data set routine is repeatedly carried out in synchronization with the timing pulses generated by the timing pulse generator 40.

Before the data set routine is started, the pattern code numbers of selected patterns have been stored in the areas designated by the combination pointer and the total data number of the first pattern has been read out by another control routine. In FIG. 4A, for instance, the pattern code numbers of a pattern A, a right step pattern, a pattern B, a left step pattern, and a pattern C have been successfully stored in the areas No. 0 to 4 designated by the combination pointer and the total data number of the pattern A have been read out.

First, the data pointer is incremented at step S100. The incremented value of the data pointer is compared with the total data number at step S110. If the value of the data pointer is smaller than the total data number, pattern data such as the data for feed amount in the primary feed direction, the data for needle rock amount, the data for lateral feed amount, and the data for needle bar release indicated by the data pointer are set at step S120 and the processing exits from the routine.

If the incremented value of the data pointer at step S100 is judged as much as or more than the total data number at step S110, the pattern has been considered sewn and the data pointer is reset at step S130.

Then, the value of the combination pointer is compared with the total number of the combined patterns at step S140. If the value of the combination pointer is smaller than the total number of the combined patterns, the value of the combination pointer is incremented by one at step S150.

Next, it is determined whether or not the pattern indicated by the combination pointer is a step pattern at step S160. If not, the total data number of the pattern is set at step S170. If so, the total data number of the step pattern corresponding to the width is set in accordance with the table shown in FIG. 5 at step S180.

After the total data number is set at either step S170 or S180, the pattern data is set at step S120. At this point, it is the pattern data indicated by the data pointer No. 0 which determines where the first needle location is set.

Steps S100 to S180 are repeatedly executed until all the patterns indicated by the combination pointer are sewn. When all the patterns are sewn, the value of the combination pointer is determined to be equal to the total pattern combination number at step S140 and the process goes to step S190.

Step S190 determines whether the patterns sewn in the above process are set to be repeatedly sewn. If YES, the combination pointer is reset at step S200 and the process goes back to step S160 at which the total data number of the pattern designated by the combination pointer No. 0 is set. If NO at step S190, a rotation stop flag is set for stopping the rotation of the sewing shaft of the sewing machine at step S210 and the pattern data set routine ends.

Figure 7:
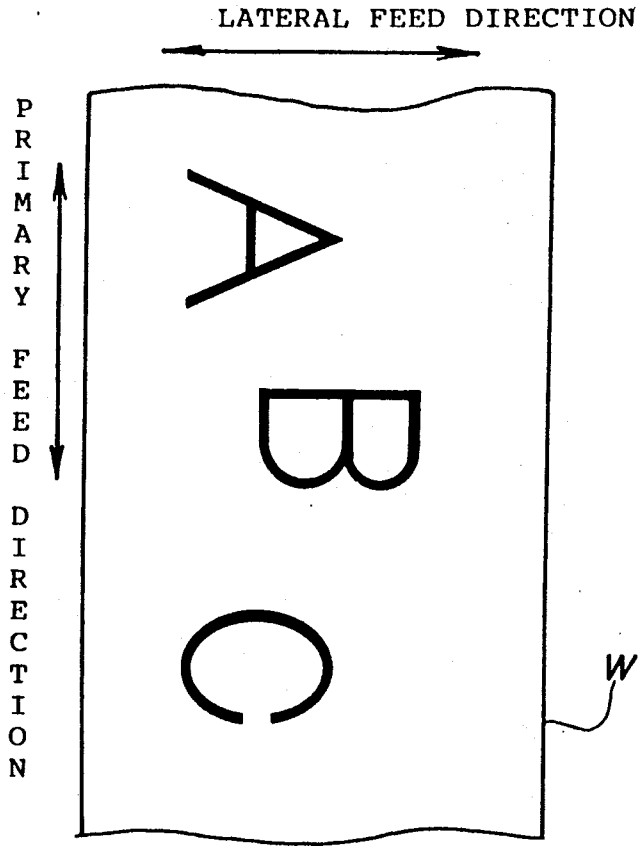
FIG. 7 shows an example of patterns sewn on a fabric using designated patterns of the first embodiment.
Figure 8:
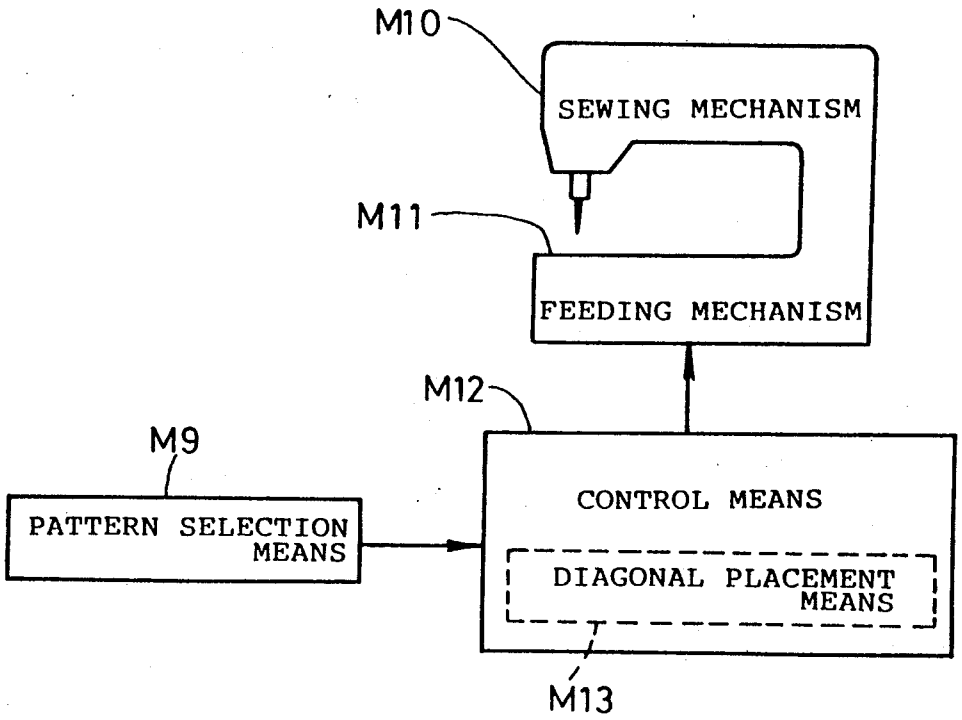
FIG. 8 is a block diagram showing the composition of the second embodiment of the present invention.

According to the present routine, the selected patterns indicated in FIG. 4A are sewn as shown in FIG. 7. The pattern B is sewn to the right of the pattern A while pattern C is sewn diagonally toward the left from pattern B. In the present embodiment, the total data number of a step pattern is predetermined so that the distance by which a pattern is moved in the lateral feed direction is approximately half the lateral width of the pattern.

The pattern sewing machine of the present embodiment explained above cannot only sew patterns in a straight line but also change the course of a combination of patterns in the lateral direction. Therefore, it can sew patterns with greater variety.

The lateral feed amount of the fabric W in one feed operation is set at 0.7 mm; so the number of lateral feeding operations is determined in accordance with the size of the pattern. In this way, the lateral feed amount caused by the feed dog 63 matches the actual distance by which the fabric W is to be transferred. The intended feed amount is thus accurately achieved. Furthermore, the relative position of two patterns remains the same regardless of the size of the patterns. Therefore, a neat arrangement of the sewn patterns is secured. Moreover, manual adjustment of the position of the fabric is no longer necessary, unlike conventional pattern sewing machines, making pattern sewing easier and less troublesome.

While the described embodiment represents the preferred form of the present invention, it is to be understood that changes and variations may be made without departing from the spirit and the scope of the invention.

For instance, the amount of the lateral feed of the fabric may be 0.6 or 0.5 mm per lateral feeding operation so that an increased total data number of a step pattern will realize finer adjustment of the lateral feed amount.

Second Embodiment

Figure 9:
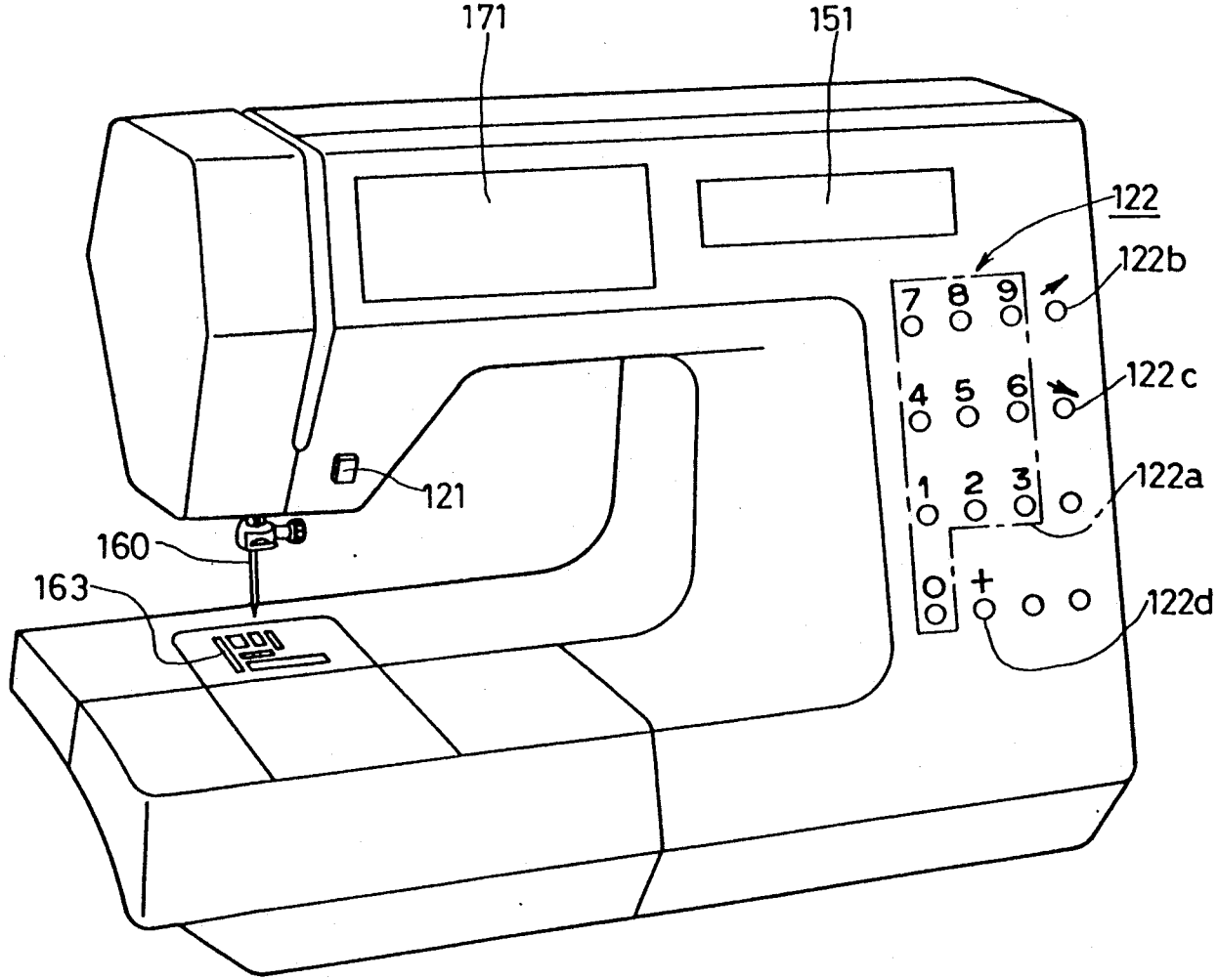
FIG. 9 is a perspective view of a pattern sewing machine of the second embodiment of the present invention.

The pattern sewing machine of a second embodiment shown in FIG. 9 automatically forms names, symbols, or the like under control of an operation section provided in the front of the casing. The operation section includes pattern selection switches 122 for selecting patterns, an on/off switch 121 for starting sewing, which is provided close to a needle 160, and a feed dog 163.

A display 151 for displaying selected patterns and a reference panel 171 for showing different types of patterns available for sewing are also provided in order to facilitate selection of patterns.

The pattern selection switches 122 comprises a numeric key pad 122*a* for selecting patterns by entering double-digit figures, a pattern combination key 122*d* for combining selected patterns, a right step key 122*b* for diagonally placing patterns to the right of the operator, and a left step key 122*c* for diagonally placing patterns to the left of the operator.

The display 151 is provided with a liquid crystal dot matrix display (referred to as LCD hereinafter) which displays the double-digit figures or approximate shapes of the pattern designated by the double digit figures according to the dot matrix pattern. The reference panel 171 displays the letters, symbols, and the like corresponding to the double-digit figures entered by the numeric key pad 122*a*. A pattern such as a symbol or an alphabetical letter is displayed for the corresponding double-digit figure.

Figure 10:
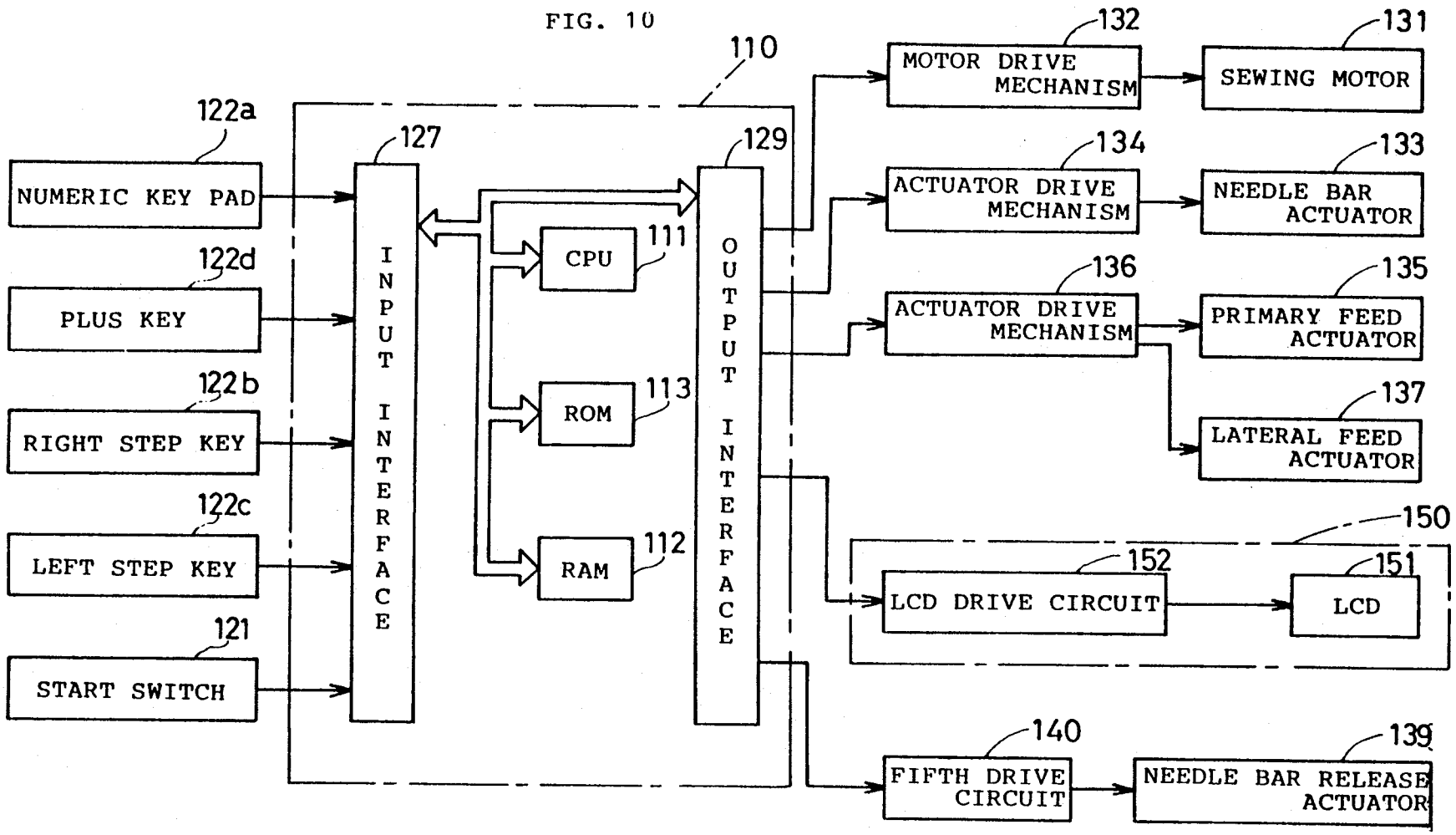
FIG. 10 is a block diagram showing the electrical composition of the sewing machine of the second embodiment of the present invention.

FIG. 10 is a block illustration of a computer 110 which drives the sewing mechanism of the sewing machine of the present embodiment in accordance with an operation on the operation section.

The computer 110 is provided with a CPU 111, a ROM 113, a RAM 112, an input interface 127, and an output interface 129. The input interface 127 is connected with the numeric key pad 122*a*, the right step key 122*b*, the left step key 122*c*, and the on/off switch 121 of the operation section explained above. On the other hand, the output interface 129 is connected with a motor drive mechanism 132 for driving a sewing motor 131, an actuator drive mechanism 134 for driving a needle bar actuator 133 for rocking the needle 160, an actuator drive mechanism 136 for driving a primary feed actuator 135 and a lateral feed actuator 137 of the feed dog 163, a LCD drive circuit 152 for driving the LCD 151, and a drive circuit 140 for driving a needle release actuator 139.

The computer 110 carries out programs stored in the ROM 113, thus performing pattern selection and pattern sewing in accordance with the instructions entered by the numeric key pad 122*a*, the right step key 122*b*, the left step key 122*c*, and, so forth.

In order to perform these operations, predetermined areas of the ROM 113 and the RAM 112 are specifically structured. Stored in the ROM 113 is stitch data 180 for each pattern for forming various patterns by driving the motor drive mechanism 132, the needle actuator drive mechanism 134 for driving the needle 160, and the actuator drive mechanism 136 of the feed dog 163.

Figure 11A:
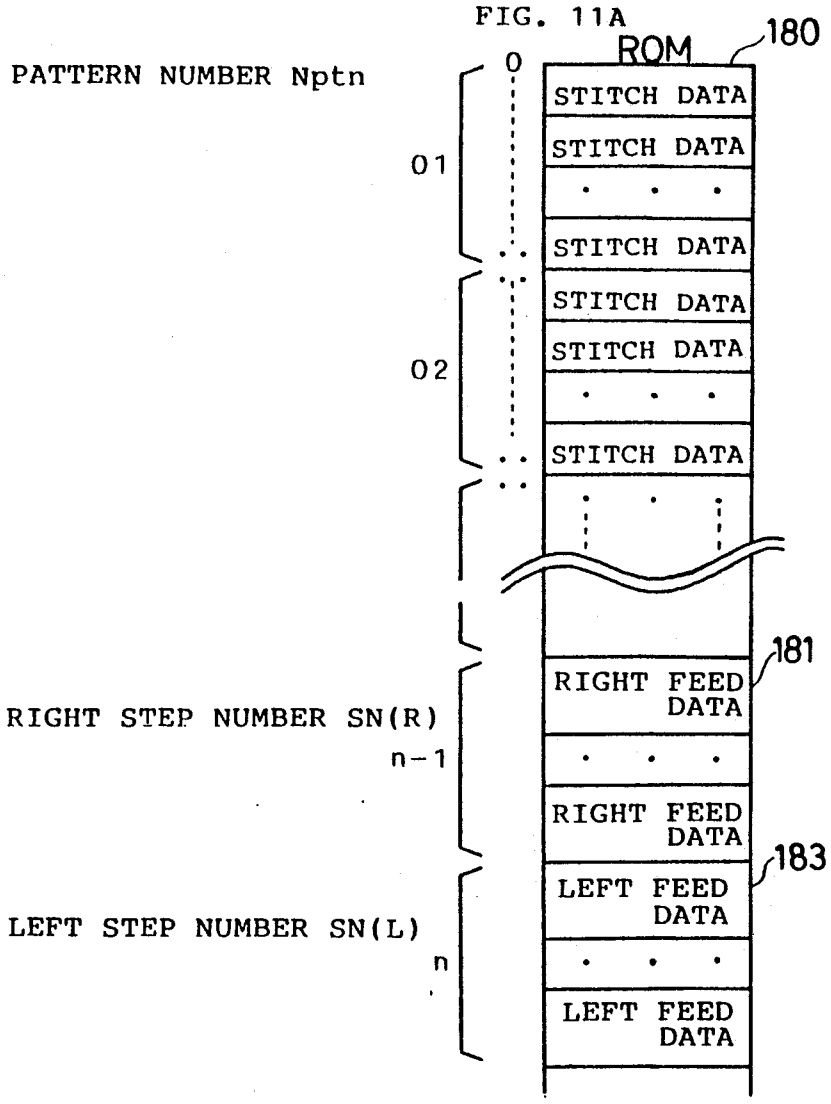

As shown in FIG. 11A, sets of stitch data 180 necessary to sew patterns such as characters or symbols are stored in the ROM 113. Each set of stitch data 180 is specified under a pattern number Nptn which is entered by the numeric key pad 122*a*.

Provided after the stitch data 180 for forming patterns are sets of right feed data 181 for moving the feed dog 163 in the lateral feed direction to the right of the operator and sets of left feed data 183 for moving the feed dog 163 in the lateral feed direction to the left. The areas in which the right and left feed data 181 and 183 are stored are specified under a right step number SN (R) and a left step number SN (L), respectively. The right and left feed data 181 and 183 are provided for transferring a fabric to either the right or the left by a predetermined distance by repeating a predetermined number of lateral feed operations carried out by the feed dog 163.

FIG. 11B is a data table showing an example of a set of the right feed data 181 in which five units of data compose a set of the feed data 181. Each unit of the right feed data 181 comprises: the lateral feed amount of the feed dog 163, which is 0.7 mm; the primary feed amount of the feed dog 163, which is 0 mm; the needle rock location of the needle 160, which is unchanged from the previous location before the right feed data is read out; and data indicating whether the needle 160 is released or engaged using a clutch mechanism for releasing the needle 160 from a main shaft or engaging the needle 160 with the main shaft.

When the feed dog 163 carries out lateral feed to the right, the five units of right feed data are successively read out in a numerical order that is designated by the data pointer. In this case, the feed dog 163 performs five right feed operations to feed the fabric W in the lateral feed direction by the same distance as the width of a pattern unit.

Not-shown units of the left feed data consist of five units of the left feed data including the same instructions as those of the right feed data except that the lateral feed amount of the left feed data is −0.7 mm.

On the other hand, the RAM 112 is provided with a pattern number memory area for storing pattern numbers Nptn. As shown in FIG. 11C, the pattern number memory area is structured such that pattern numbers Nptn are stored in order and each pattern number Nptn is specified by the value of the combination pointer P.

The pattern number memory area stores right step numbers SN(R) and left step numbers SN(L) designated by the right step key 122*b* and the left step 122*c*, respectively, as well as the pattern numbers Nptn of ordinary patterns such as the alphabetical letters corresponding to the double-digit figures entered by the numeric key pad 122*a*. The right step numbers SN(R) and the left step numbers SN(L) are also specified by the value of the combination pointer P.

In the pattern sewing machine of the present embodiment constructed as explained above, the computer 110 executes instructions, hence controlling the sewing machine based on key-manipulation.

After the power source is switched on and the initial process is completed, the computer 110 repeatedly executes a pattern selection routine as shown in the flowchart of FIG. 12A.

A pattern is selected using one or more operation keys. After a pattern selection using the operation keys is read at step S300, the type of the pattern selection keys used is determined. Then, the computer 110 repeatedly carries out a subroutine according to the type of pattern selection keys. In this way, the computer 110 controls the sewing machine in accordance with the key-manipulation.

If the pattern selection keys used to select a pattern are determined to be in the numeric key pad 122*a* at step S310, the computer 110 carries out a pattern number store subroutine in which the pattern number Nptn corresponding to the figures input by the numeric key pad 122*a* are stored in a pattern number memory area of the RAM 112 at step S320.

On the other hand, if a given key is determined to be the plus key 122*d* at step S310, a plus flag Fpls is set at step S330. The plus flag Fpls is set when a combination of letters or symbols such as a name are entered. When a plus flag Fpls is set, the pattern number Nptn selected after the plus flag Fpls is stored in the pattern number memory area after and in combination with the previously stored pattern number Nptn at step S320.

If it is determined that a given key is either the right step key 122*b* or the left step key 122*c* at step S310, the computer 110 carries out a step number memory subroutine in which the right step key number SN(R) or the left step key number SN(L) is stored in the pattern number memory area of the RAM 112 at step S340.

By carrying out the above steps, the computer 110 determines the types of operational keys and accordingly repeats the subroutines and the data processing, thereby controlling the sewing machine in accordance with the operator's intention.

The manual operation for selecting and sewing the combination of patterns as shown in FIG. 13 and the processing carried out by the computer 110 based on the manual operation will be explained as an example hereinafter.

When the letter A is entered via the numeric keypad 122*a*, the computer 110 determines that the pressed operation key is a key in the numeric key pad 122*a* at step S310 and the process steps go to step S320 at which the pattern number memory subroutine is carried out.

In the pattern number memory subroutine, whose flowchart is shown in FIG. 12B, the computer 110 first determines the double-digit figure mn entered by the numeric key pad 122*a* at step S350. Second, after the entered double-digit figure Fpls is determined, it is determined if a plus flag is set at step S360. When the first pattern is entered by the numeric key pad 122*a*, no plus flag Fpls has been set at step S360. Therefore, it is determined NO at step 360 and the value of the combination pointer P is reset to the value FF in hexadecimal notation at step S370. The value of the combination pointer P designates the combination order of the pattern number Nptn of the pattern corresponding to the entered double-digit figure mn. At step S380, the combination pointer P is incremented. Then, the pattern number Nptn(mn) of the letter A corresponding to the figure mn is specified at step 390. The pattern number Nptn identifies a set of stitch data stored in the ROM 113 required to sew the pattern (the pattern A in this case) corresponding to the double-digit figure mn. The pattern number Nptn (mn) specified in this way is stored in a memory M (P) of a predetermined address in the pattern number memory area of the RAM 112 at step S400 and program exits from the process.

The pattern number of the first entered letter A is stored in the memory M (P) of the first address designated by the combination pointer P=0.

While carrying out the above process, the computer 110 displays the operation on the display 151. As shown in FIG. 14A, the display 151 first displays the double-digit figure entered by the numeric key pad 122*a* for several seconds. Subsequently, an approximate figure of the pattern corresponding to the double-digit figure is displayed as shown in FIG. 14B.

When the plus key 122*d* is manipulated in order to combine the letter A with the letter B, the computer 110 sets a plus flag Fpls at step S330 as shown in FIG. 12A. The computer 110 also displays a plus symbol after the first letter A on the display 151 as shown in FIG. 14C.

Now, the computer 110 carries out the above-described pattern number memory subroutine when the letter B is entered by the numeric key pad 122*a*. Since a plus flag Fpls has been set, it is determined YES at step S360. Then, instead of going to step S370, the process goes to step S375 at which a plus flag Fpls is reset, and go to step S375, at which the combination pointer P is incremented. The process now goes to step S390 at which the pattern number Nptn (mn) is specified based on the double-digit number mn. Subsequently, the specified pattern number Nptn (mn) is stored in the memory M (P) of a predetermined address in the pattern number memory area of the RAM 112 and the pattern number Nptn is stored after the previous pattern number Nptn at step S400. The program exits from the pattern number memory subroutine. The memory M (P) of the predetermined address is designated by the incremented value of the combination pointer P.

As shown in FIG. 14D, the display 151 now displays the letter B instead of a plus symbol.

The process following the depression of the right step key 122*b* or the left step key 122*c* will be explained hereinafter.

Upon identifying a manipulated key as either the right step key 122*b* or the left step key 122*c*, the computer 110 goes to the step number memory subroutine at step S340. In this subroutine, after the combination pointer P is incremented at step S410, it is determined if the step key is the right step key 122*b* or the left step key 122*c* at step S420. In the present example in which the letter C is placed diagonally to the right of the letter B, the right step key 122*b* is depressed. Therefore, the process steps go to step S430 at which the right step number SN(R) is specified, and then to the step S440 at which the specified number SN(R) is stored in a memory M (P) of a predetermined address designated by the incremented value of the combination pointer P. The memory M (P) is located in the pattern number memory area of the RAM 112. Finally, a plus flag Fpls is set for the following key-pad manipulation at step S450 and the program exits from the processing.

At this point, the display 151 displays an arrow after the letter B as shown in FIG. 14E based on display processing carried out by the computer 110. The displayed arrow is the arrow drawn on the upper panel surface above the right step key 122*b*.

When the numeric key pad 122*a* is manipulated to enter the letter C, the computer 110 again carries out the pattern number store subroutine as shown in the flowchart of FIG. 12B. Since a plus flag Fpls is set in the previous step number memory subroutine, the computer 110 skips the reset of the combination pointer P at step S470 and increments the combination pointer P at step S480. Then, the pattern number corresponding to the letter C is stored in a memory M (P) of a predetermined address designated by the incremented value of the combination pointer P. The memory M(P) is located in the pattern number memory area of the RAM 112. The display 151 displays the letter C after the arrow symbol as shown in FIG. 14F.

When the left step key 122*c* is depressed in order to diagonally place the letter D to the left of the letter C, the computer 110 goes to the step number memory subroutine at step S340. In the step number memory subroutine, after the combination pointer P is incremented at step S410, it is determined if the manipulated operational key is the right step key 122*b* or the left step key 122*c* at step S420 as shown in the flowchart of FIG. 12C. Since the left step key 122*c* has been depressed in this case, the left step number SN(L) is specified at step S460 and the specified left step number SN(L) is stored in a memory M(P) designated by the incremented value of the combination pointer at step S470. The memory M(P) is located in the predetermined address of the pattern number memory area in the RAM 112. Subsequently, a plus flag Fpls is set at step S250 and the program exits from the processing.

The display 151 displays an arrow after the letter C. The displayed arrow is the arrow drawn on the panel over the left step key 122*c*.

When the numeric key pad 122*c* is manipulated to enter the last letter D, the computer 110 repeats the pattern number store subroutine as shown in the flowchart of FIG. 12B to store the pattern number Nptn corresponding to the letter D in the memory M(P) of a predetermined address. The memory M(P) is located in the pattern number memory area of the RAM 112. The display 151 displays the letter D after the arrow as shown in FIG. 14H.

Figure 11D:
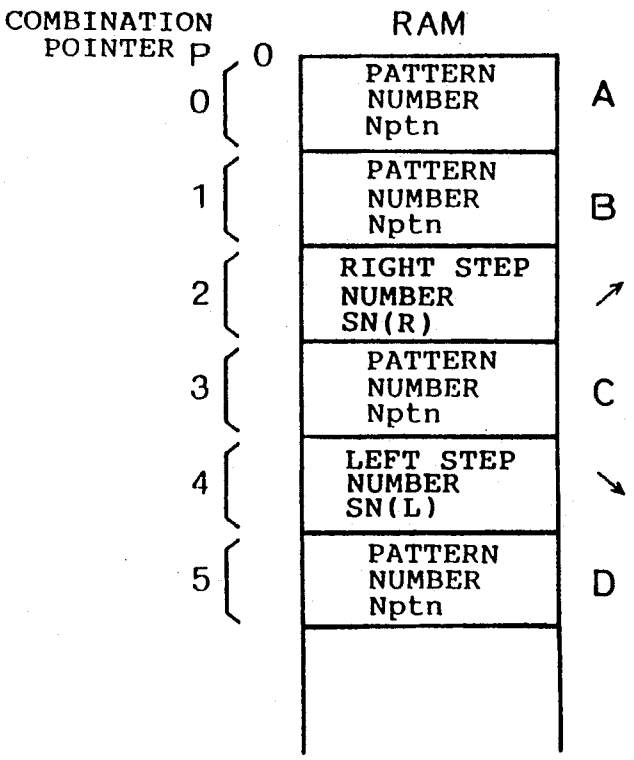
Figure 11C:
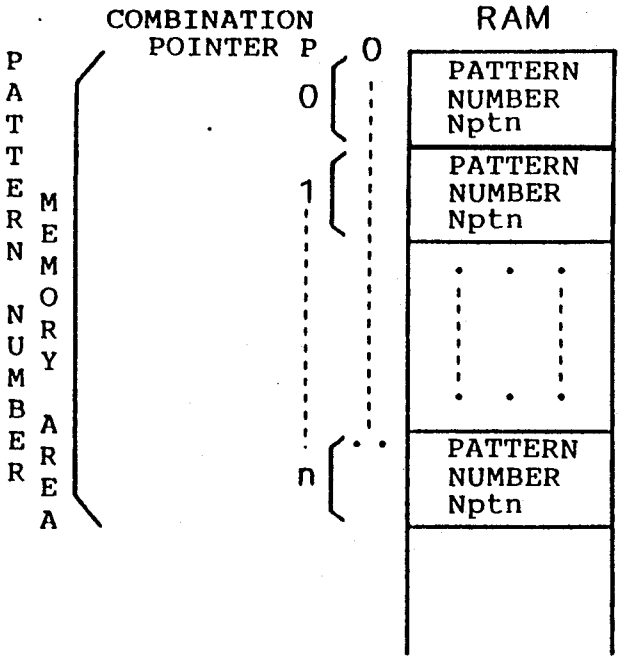

In accordance with the foregoing operation and the processing following the operation, the pattern numbers Nptn of the letter A, B, the right step number SN(R), the pattern number of the pattern C, the left step number SN(L), and the pattern number of the letter D are successively stored in order in the memory M in the pattern number memory area of the RAM 112, as shown in FIG. 11D.

Upon depressing the on/off switch 121, the computer 110 ends the above-explained pattern selecting operation and starts a pattern sewing operation. In the pattern sewing operation, the computer 110 reads out the pattern numbers Nptn, the right step number SN(R), or the left step number SN(L) in numerical order of the combination pointer P, which numbers are successively stored in the RAM 112. The computer also reads from the ROM 113 the stitch data 50, the right feed data 51, or left feed data 53 corresponding to the read-out pattern numbers Nptn, the right step number SN(R), and the left step number SN(L), respectively, and drives the sewing mechanism of the pattern sewing machine in the same order as the patterns have been entered.

After the letter A and B are sewn in the primary feed direction, the feed dog 163 laterally transfers the fabric W to the right by carrying the fabric W a predetermined number of right feeding operations (five operations in the present embodiments) based on the right feed data, thus moving the starting point of the letter C. In this way, since the starting point of the letter C is moved in the lateral feed direction to the right by the width of the letters prior to sewing, the letter C is diagonally placed to the right of the letter B as shown in FIG. 13. While the feed dog 163 carries out the five right feed operations, the clutch of the sewing shaft is released to suspend sewing on the fabric.

After the letter C is sewn, the feed dog 163 laterally transfers the fabric W to the left by carrying out a predetermined number of feeding operations (five operations in the present embodiment ) based on the left feed data, thus moving the starting point of the letter D. In this way, since the starting point of the letter D is moved in the lateral feed direction to the left by the width of the letters before sewing, the letter D is diagonally placed to the left of the letter C as shown in FIG. 13. While the feed dog 163 carries out the five left feed operations, the clutch of the sewing shaft is released to suspend sewing on the fabric.

As explained above, in the sewing machine of the present embodiment, the numeric key pad 122*a* is manipulated in combination with the right step key 122*b* and the left step key 122*c* for selecting pattern units to form pattern units in a variety of directions. Therefore, the sewing machine of the present embodiment offers the advantage of realizing a previously unattainable formation of combined pattern units whose aesthetic value is greater than that sewn by conventional pattern sewing machines due to the greater variety of sewing directions.

Furthermore, in the pattern sewing machine of the present embodiment, various operational keys such as the right and left step keys 122*b* and 122*c* and those on the numeric key pad 122*a* are manipulated in combination, and the plus key 122*d* need not to be manipulated in combination with right or the left step key 122*b* and 122*c*. It is, therefore, easy to combine and sew pattern units either in a straight line in the primary feed direction or change the course of the combined patterns in the lateral direction. The operator needs only manipulate corresponding operational keys in the same order as the pattern units to be combined. The operator thus does not have to learn a complicated pattern selection procedure.

Moreover, the right and left feed data 181 and 183 includes the instruction for releasing the clutch mechanism of the sewing shaft so that sewing is suspended while the fabric is laterally transferred. Therefore, the sewn patterns are neat in appearance.

While the described embodiment represents the preferred form of the present invention, it is to be understood that changes and variations may be made without departing from the spirit and the scope of the invention.

In the present embodiment, the amount by which the fabric is transferred in the lateral feed direction by the feed dog 163 is a predetermined amount; that is, the lateral feed amount is the width of the patterns to be sewn. However, when patterns of different sizes are to be sewn in combination, the fabric may be transferred by various amounts. For instance, the fabric may be transferred by the width of the pattern to be sewn first of the two adjacent patterns or by one of different predetermined amounts designated for each pattern. The lateral feed amount can also be the average width of two adjacent patterns.

The diagonal placement means may automatically place entered patterns in a diagonal direction to the primary feed direction.

The pattern sewing machine of the present invention has the advantage of realizing a previously unattainable formation of combined pattern units whose aesthetic value is grater than that sewn by conventional pattern sewing machines due to the greater variety of sewing directions. Also, not only can the pattern sewing machine of the present invention sew patterns in a straight line, but it can also change the course of patterns. Therefore, it can arrange patterns with greater variety.

The lateral feed amount of the fabric in one feeding operation is set at a predetermined amount; so the number of lateral feeding operations is determined in accordance with the size of a pattern. In this way, the fabric is accurately transferred. Furthermore, the relative position of two patterns remains the same regardless of the size of the patterns and the neat arrangement of the sewn patterns is obtained. Moreover, manual adjustment of the position of the fabric is no longer necessary, unlike conventional pattern sewing machines, making pattern sewing easier and less troublesome.

What is claimed is:

1. A pattern forming sewing machine, comprising:

transfer means for moving a fabric in a primary feed direction;

needle drive means for driving a sewing needle to form stitches on the fabric;

pattern selection means for selecting at least one pattern unit, from a plurality of pattern units, to be sewn on the fabric;

sewing control means for controlling the transfer means to move the fabric and the needle drive means to move the needle such that the needle forms a series of the selected pattern units on the fabric;

diagonal placement means for placing at least one of the selected pattern units in the series in a position diagonal to the position of the adjacent, previously formed pattern unit in the series; and display means for displaying the selected pattern units, where the display means displays a character for indicating diagonal placement on the display means between two adjacent pattern units, the second of which is to be placed in a position diagonal to the position of the first.

2. The pattern forming sewing machine of claim 1, in which the selected pattern is placed in a lateral direction from the position of the adjacent, previously formed pattern a lateral distance substantially equal to a lateral width of the selected pattern units.

3. The pattern forming sewing machine of claim 1, further comprising:

lateral transfer means for transferring the fabric in at least one direction lateral to the primary feed direction to form pattern units in positions diagonal to the positions of adjacent, previously formed pattern units; and disengagement means for disengaging the needle drive means from a main shaft to suspend sewing while the lateral transfer means is transferring the fabric.

4. The pattern forming sewing machine of claim 2, in which the lateral distance is determined according to a size of the pattern units.

5. The pattern forming sewing machine of claim 4, in which the lateral distance is one half of a lateral width of the pattern units.

6. The pattern forming sewing machine of claim 4, further comprising:

lateral transfer means for transferring the fabric in predetermined lateral feed increments in at least one direction lateral to the primary feed direction to form pattern units in positions diagonal to the positions of adjacent, previously formed pattern units; and calculation means for calculating the lateral distance by multiplying the lateral feed increments by a number of lateral feed increments.

7. The pattern forming sewing machine of claim 6, in which the number of lateral feed increments is predetermined for each pattern unit.

8. A pattern forming sewing machine, comprising:

transfer means for moving a fabric in a primary feed direction and at least one lateral feed direction;

needle drive means for driving a sewing needle to form stitches on a fabric surface and for moving the needle lateral to the primary feed direction;

pattern selection means for selecting a plurality of pattern units to be sewn on the fabric;

lateral feed instruction means for indicating which of the selected plurality of pattern units are lateral feed pattern units to be sewn at a position lateral to the primary feed direction;

lateral feed control means for controlling the transfer means to transfer the fabric a lateral feed distance in a lateral direction before each lateral feed pattern unit is sewn; and sewing control means for controlling the transfer means to transfer the fabric a primary feed distance in the primary feed direction after each pattern unit is sewn and for controlling the transfer means to move the fabric and the needle drive means to move the needle to form the selected pattern units on the fabric.

9. The pattern forming sewing machine of claim 8, further comprising:

size determination means for determining a size of the selected pattern units; and calculation means for calculating the lateral feed distance based on the size determined by the size determination means; wherein the sewing control means controls the transfer means and needle drive means such that the needle forms selected pattern units of the size determined by the size determination means.

10. The pattern forming sewing machine of claim 8, in which the transfer means moves the fabric in first and second lateral feed directions.

11. The pattern forming sewing machine of claim 10, in which the lateral feed control means controls the transfer means to transfer the fabric in one lateral feed direction prior to the formation of each lateral feed pattern unit and in the other lateral feed direction after the formation of each lateral feed pattern.

12. The pattern forming sewing machine of claim 10, in which:

the lateral feed instruction means further indicates whether each of the lateral feed pattern units is a first lateral feed pattern unit or a second lateral feed pattern unit; and the lateral feed control means controls the transfer means to transfer the fabric in the second lateral feed direction before the first lateral feed pattern units are formed and in the first lateral feed direction before the second lateral feed pattern units are formed.

13. The pattern forming sewing machine of claim 12, in which the lateral feed control means controls the transfer means to transfer the fabric in one lateral feed direction prior to the formation of each lateral feed pattern unit and in the other lateral feed direction after the formation of each lateral feed pattern.

14. The pattern forming sewing machine of claim 8, further comprising display means for displaying the selected pattern units, where the display means displays on the display before each lateral feed pattern unit a character for indicating that the next character is a lateral feed pattern unit.

15. The pattern forming sewing machine of claim 9, in which the lateral feed distance is substantially equal to a lateral width of the pattern units.

16. The pattern forming sewing machine of claim 9, in which the lateral feed distance is one half of a lateral width of the pattern units.

17. The pattern forming sewing machine of claim 8, further comprising disengagement means for disengaging the needle drive means from a main shaft to suspend sewing while the transfer means is transferring the fabric.

18. The pattern forming sewing machine of claim 12, in which:

the transfer means transfers the fabric in predetermined lateral feed increments in the lateral feed direction; and the calculation means calculates the lateral distance by multiplying the lateral feed increments by a number of lateral feed increments.

19. The pattern forming sewing machine of claim 18, in which the number of lateral feed increments is predetermined for each pattern unit.

20. A pattern forming sewing machine, comprising:

transfer means for moving a fabric in a primary feed direction and at least one lateral feed direction;

needle drive means for driving a sewing needle to form stitches on a fabric surface;

pattern selection means for selecting a plurality of pattern units to be sewn on the fabric;

lateral feed instruction means for indicating which of the selected plurality of pattern units are lateral feed pattern units to be sewn at a position lateral to the primary feed direction;

lateral feed control means for controlling the transfer means to transfer the fabric a lateral feed distance in a lateral direction based on a size of the selected pattern units before each lateral feed pattern unit is sewn;

and sewing control means for controlling the transfer means to transfer the fabric a primary feed distance in the primary feed direction after each pattern unit is sewn and for controlling the transfer means to move the fabric and the needle drive means to move the needle to form the selected pattern units on the fabric.

* * * * *